US008248307B2

(12) United States Patent
Chung et al.

(10) Patent No.: US 8,248,307 B2
(45) Date of Patent: Aug. 21, 2012

(54) PLANAR ANTENNA AND ELECTROMAGNETIC BAND GAP STRUCTURE THEREOF

(75) Inventors: Shyh-Jong Chung, Hsinchu County (TW); Ching-Wei Ling, Tainan County (TW); Tzu-Hsien Yang, Taipei (TW)

(73) Assignee: National Chiao Tung University, Hsinchu (TW)

( * ) Notice: Subject to any disclaimer, the term of this patent is extended or adjusted under 35 U.S.C. 154(b) by 400 days.

(21) Appl. No.: 12/628,182

(22) Filed: Nov. 30, 2009

(65) Prior Publication Data

US 2011/0057851 A1 Mar. 10, 2011

(30) Foreign Application Priority Data

Sep. 8, 2009 (TW) ..... 98130267 A

(51) Int. Cl.
*H01Q 1/38* (2006.01)

(52) U.S. Cl. ..... 343/700 MS; 343/749; 343/909; 343/793

(58) Field of Classification Search ..... 343/700 MS, 343/749, 909, 793
See application file for complete search history.

(56) References Cited

U.S. PATENT DOCUMENTS 7,760,154 B2 * 7/2010 Sekine et al. ..... 343/795
2004/0160367 A1 * 8/2004 Mendolia et al. ..... 343/700 MS
* cited by examiner

*Primary Examiner* — Dieu H Duong
(74) *Attorney, Agent, or Firm* — CKC & Partners Co., Ltd.

(57) ABSTRACT

An electromagnetic band-gap structure includes a circuit board, a ground plane and a plurality of electromagnetic band-gap units. The circuit board includes a first side and a second surface, and the ground plane disposed on the first side. The plurality of electromagnetic band-gap units are located on both the first surface and the second surface and connected to each other along an edge of the ground plane. Every electromagnetic band-gap unit includes a first strip line, a second strip line and a via. The first strip line is located on the first side, including a first relative long strip line and a first relative short strip line connected to the ground. The second strip line is located on the second side. The second strip line is connected to the first strip line of the adjacent electromagnetic band-gap unit through the via.

20 Claims, 9 Drawing Sheets

PLANAR ANTENNA AND ELECTROMAGNETIC BAND GAP STRUCTURE THEREOF

RELATED APPLICATIONS

This application claims priority to Taiwan Application Serial Number 98130267, filed Sep. 8, 2009, which is herein incorporated by reference.

BACKGROUND

1. Field of Invention

The present invention relates to an electromagnetic band-gap structure. More particularly, the present invention relates to a planar antenna with an electromagnetic band-gap structure.

2. Description of Related Art

Due to rapid development in information technology, applications on electronic devices have become more complex and are able to do more things. Therefore electronic devices such as notebooks, personal digital assistants (PDA) etc. have been frequently used in our daily life. This not only provides increased convenience and efficiency, but also causes the compression of time and space, where the culture and information exchange is becoming more frequent than ever before so as to achieve the optimal welfare for all mankind. Accordingly, the antenna plays an important role in communication and transportation technology applications, spreading the messages and knowledge more conveniently.

In antenna design, the metal plate is often used as the reflector plane or ground plane in the antenna so as to constitute a perfect electric conductor. However, if the metal plate and the antenna are getting too close, there would exist an image current on the metal plate, flowing in a direction opposite that of the current on the antenna, and therefore the current might cancel with each other so as to result in a poor radiation efficiency and antenna gain. Consequently, the distance between the antenna and metal ground plane should be large enough to increase antenna gain and lower the backward radiation in order to reduce unnecessary loss.

As the evolution of the communication product is to be smaller and shorter, the in exact height of the antenna is determined by the height of the product, resulting in a demand for the low profile design and the minimum size. In addition, the embedded antenna applied in the notebook or PDA is principally disposed on the fringe of the screen, which is narrow area with a limited width, so that the antenna and the ground plane are too close to maintain the radiation efficiency and communication quality. In the former method, the two dimension electromagnetic band-gap structure is adopted to be equivalent to a parallel LC resonant circuit at the corresponding operating frequency. When the parallel LC resonant circuit resonates, the impedance would become extremely high so as to make the electromagnetic band-gap structure work. However, with the use of the structure having a high impedance surface, the image current would have the same phase with the antenna in order to maintain the original characteristic of antenna and achieve the demand of the low profile design. In the general application, a large area of the two dimension electromagnetic band-gap structure is basically needed. Furthermore while designed with the antenna, the electromagnetic band-gap structure would become a three-dimension structure. As a result, the two dimension electromagnetic band-gap structure is insufficient for practical use.

Accordingly, what we need the most is a one dimension electromagnetic band-gap structure, used for being equivalent to a perfect magnetic conductor at the corresponding operating frequency. In accordance with the features, it cannot only shorten the distance between the antenna and the ground plane and maintain the characteristics of the antenna, but also be embedded in the small-size wireless communication products.

SUMMARY

The present invention provides an electromagnetic band-gap structure, which has a plurality of electromagnetic band-gap units disposed in periodical. At the operation frequency, the electromagnetic band-gap structure could be equivalent to an LC parallel circuit, and therefore the electromagnetic band-gap structure could be regarded as a perfect magnetic conductor.

According to one embodiment of the present invention, an electromagnetic band-gap structure includes a circuit board, a ground plane and a plurality of electromagnetic band-gap units. The circuit board has a first surface and a second surface opposite the first surface, and the ground plane is disposed on the first surface. The plurality of electromagnetic band-gap units are located on the first surface and the second surface. The plurality of electromagnetic band-gap units are connected to each other along an edge of the ground plane, and every electromagnetic band-gap unit includes a first strip line, a second strip line and a via. The first strip line is located on the first surface of the circuit board, and the first strip line has a relatively short line and a relatively long line, where the relatively short line and the relatively long line are connected to each other, and the relatively short line is connected to the ground plane. The second strip line is located on the second surface of the circuit board, and the portion of the second strip line is aligned with the relatively long line. Furthermore, the via is through the circuit board, which has the second strip line and a first strip line of the neighboring electromagnetic band-gap unit connected.

According to another embodiment of the present invention, an electromagnetic band-gap structure includes a circuit board, a ground plane and a plurality of electromagnetic band-gap units. The circuit board has a surface, and the ground plane is disposed on the surface. The plurality of electromagnetic band-gap units are located on the surface of the circuit board. The plurality of electromagnetic band-gap units are connected to each other along a edge of the ground plane, and every electromagnetic band-gap unit includes a strip line and a chip capacitance. The strip line located on the surface of the circuit board has a relatively short line, a first relatively long and a second relatively long line, where the relatively short line and the first relatively long line are connected to each other, and the relatively short line is connected to the ground plane. Moreover, the chip capacitance is serially connected to the first relatively long line and the second relatively long line.

The present invention also provides a planar antenna with the electromagnetic band-gap structure disposed in periodical, which could greatly shorten the distance between the antenna and a ground plane.

According to another embodiment of the present invention, a planar antenna with the electromagnetic band-gap structure includes a circuit board, a ground plane, a plurality of electromagnetic band-gap units and an antenna. The circuit board has a first surface and a second surface opposite the first surface, and the ground plane is disposed on the first surface. The plurality of electromagnetic band-gap units are located on the first surface and the second surface. The plurality of electromagnetic band-gap units are connected to each other along an edge of the ground plane, and every electromagnetic band-gap unit includes a first strip line, a second strip line and a via. The first strip line is located on the first surface of the circuit board, and the first strip line has a relatively short line and a relatively long line, where the relatively short line and the relatively long line are connected to each other, and moreover the relatively short line is connected to the ground plane. The second strip line is located on the second surface, wherein the portion of the second strip line is aligned with the relatively long line. The via is through the circuit board, which has the second strip line and a first strip line of the electromagnetic band-gap unit connected. Furthermore, the antenna is disposed above the electromagnetic band-gap unit.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiments, with reference made to the accompanying drawings as follows.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
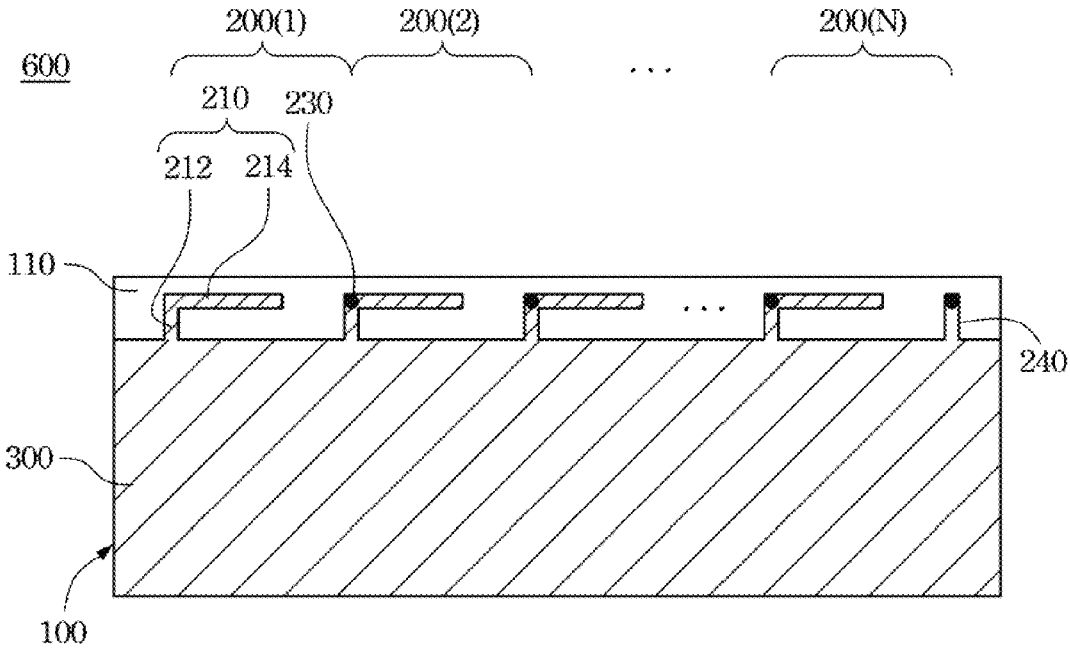
FIG. 1 shows a first surface of an electromagnetic band-gap structure according to one embodiment of the present invention.
Figure 2:
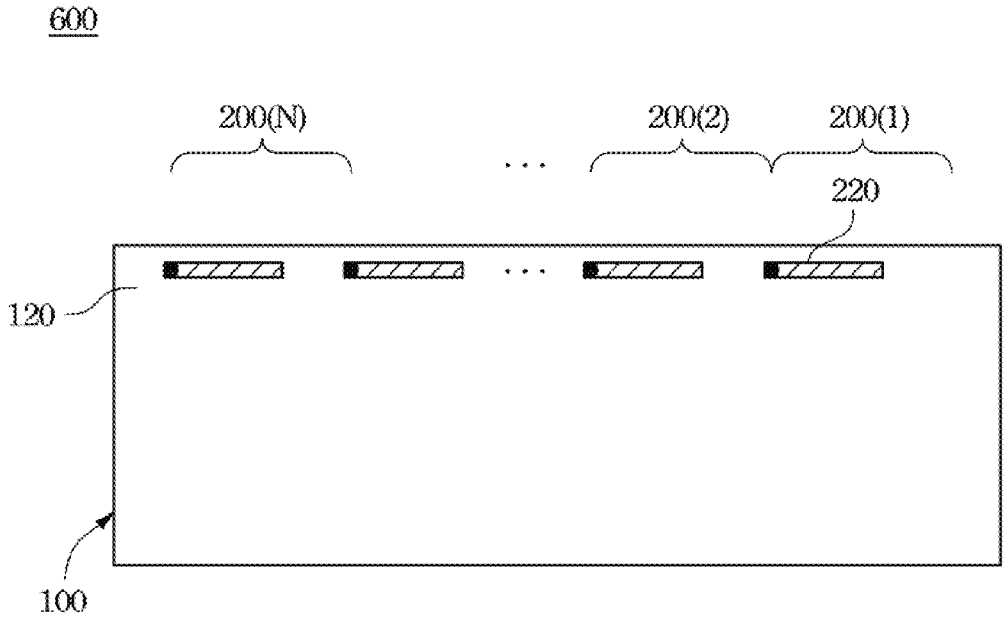
FIG. 2 shows a second surface of an electromagnetic band-gap structure according to one embodiment of the present invention.

FIG. 1 and FIG. 2 are the drawings of the first and the second surface of the electromagnetic band-gap structure respectively, according to the embodiments of the present invention. As shown in FIG. 1 and FIG. 2, the electromagnetic band-gap structure 600 includes a circuit board 100, a ground plane 300 and a plurality of electromagnetic band-gap units 200(1)~200(N). The circuit board 100 has a first surface 110 and a second surface 120, which are opposite to each other, and the ground plane 300 is disposed on the first surface 110. A plurality of electromagnetic band-gap units 200(1)~200(N) is located on the first surface 110 and the second surface 120. The plurality of electromagnetic band-gap units 200(1)~200(N) are connected to each other along a edge of the ground plane 300, and every electromagnetic band-gap unit includes a first strip line 210, a second strip line 220 and a via 230. The first strip line 210 is located on the first surface 110 of the circuit board 100, and furthermore the first strip line 210 has a relatively short line 212 and a relatively long line 214, where the relatively short line 212 and the relatively long line 214 are connected to each other, and the relatively short line 212 is connected to the ground plane 300. The second strip line 220 is located on the second surface 120 of the circuit board 100, and the portion of the second strip line 220 is aligned with the relatively long line 214. Moreover, the via 230 is through the circuit board 100, which has the second strip line 220 and a first strip line 210 of the neighboring electromagnetic band-gap unit connected.

Referring to FIG. 1 and FIG. 2, the electromagnetic band-gap structure 600 further includes a third strip line 240 connected to the ground plane 300, where third strip line 240 is located on the first surface 110 and disposed next to the last electromagnetic band-gap unit 200(N). Consequently, the third strip line 240 is connected the second strip line 220 of the last electromagnetic band-gap unit 200(N) through the via 230 of the last electromagnetic band-gap unit 200(N). In addition, the size of the ground plane 300 is a ground plane of the notebook or PDA.

The electromagnetic band-gap structure 600 mentioned above, the ground plane 300 has a rectangular shape. The first strip line 210 and second strip line 220 respectively have an L-shape and a long shape, and the third strip line 240 also has a long shape. Additionally, the first strip line 210, the second strip line 220 and the third strip line 240 are all printed lines on the circuit board 100.

Figure 3:
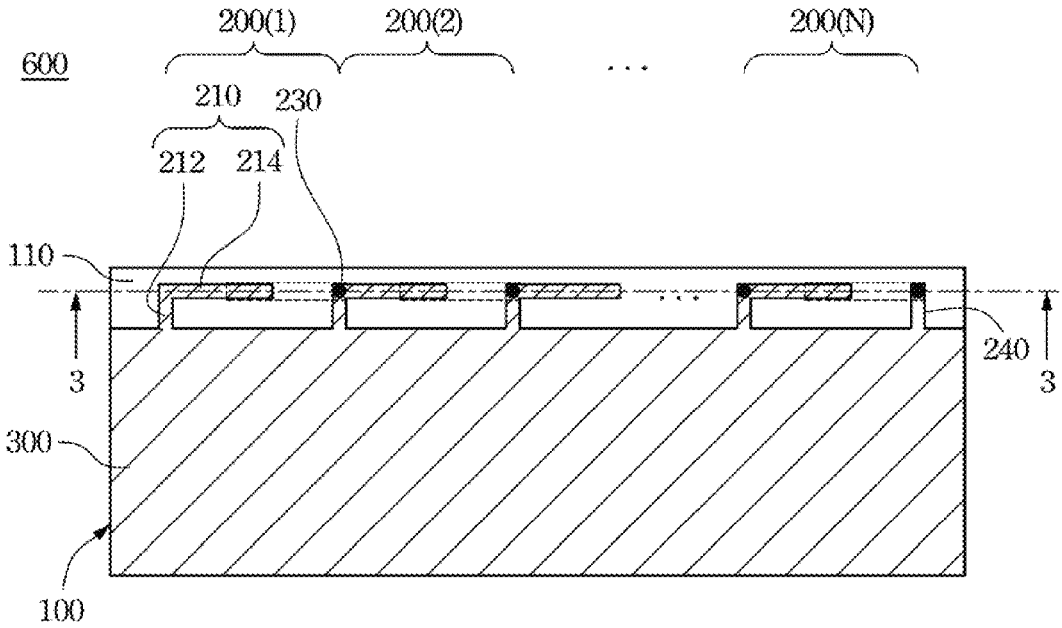
FIG. 3 shows a top view of an electromagnetic band-gap structure according to one embodiment of the present invention.
Figure 4:
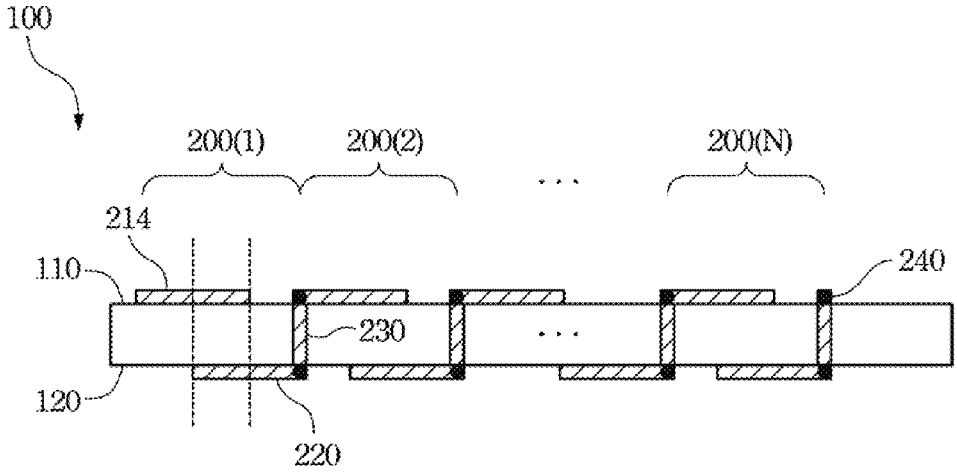
FIG. 4 shows a cross-sectional view taken along line 3-3 of FIG. 3.

Referring to FIG. 3 and FIG. 4, the FIG. 3 is the top view of the electromagnetic band-gap structure according to the embodiment of the present invention, and the FIG. 4 is a cross-sectional view taken along line 3-3 of FIG. 3. As shown is FIG. 3 and FIG. 4, the alignment portion of the relatively long line 214 and the second strip line 220 in the every electromagnetic band-gap unit are shown with the dash line. At the operation frequency of the electromagnetic band-gap structure, the alignment portion constitutes a capacitance. Additionally, the more alignment portions between the relatively long line 214 and the second strip line 220 are, the higher the corresponding value of capacitance is. Furthermore, at the operation frequency of the electromagnetic band-gap structure, the non-alignment portions, which are between the first strip line 210 and the second strip line 220, and the fringe of the neighboring ground plane 300 could constitute inductance. The longer the lengths of the first strip line 210 and the second strip line 220 are, the higher the corresponding value of the inductance is.

As a plane wave is normally incident upon the electromagnetic band-gap structure 600, the plurality of electromagnetic band-gap units 200(1)~200(N) could be equivalent to a LC parallel circuit with the high impedance surface and the reflect phase of zero degree. Therefore, at the operation frequency of the electromagnetic band-gap structure, the electromagnetic band-gap structure might be equivalent a perfect magnetic conductor.

Figure 5:
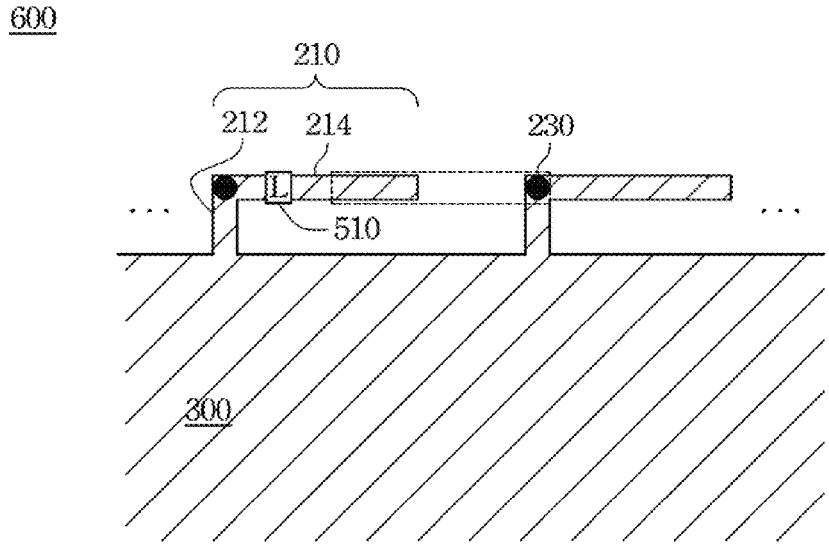
FIG. 5 shows the portion of the electromagnetic band-gap structure with the chip inductance according to one embodiment of the present invention.

FIG. 5 is the drawing of the portion of the electromagnetic band-gap structure with the chip inductance according to one embodiment of the present invention. As shown in the FIG. 5, the electromagnetic band-gap structure 600 includes a chip inductance 510 serially connected to non-alignment portions of the first strip line 210 and the second strip line 220, and the chip inductance 510 is used for changing the value of the inductance in the equivalent circuit so as to modulate the operation frequency of the electromagnetic band-gap structure 600. Furthermore, the accurate number of the chip inductance 510 applied in the present invention is not limited by the FIG. 5 but determined by the practical demand.

Figure 6:
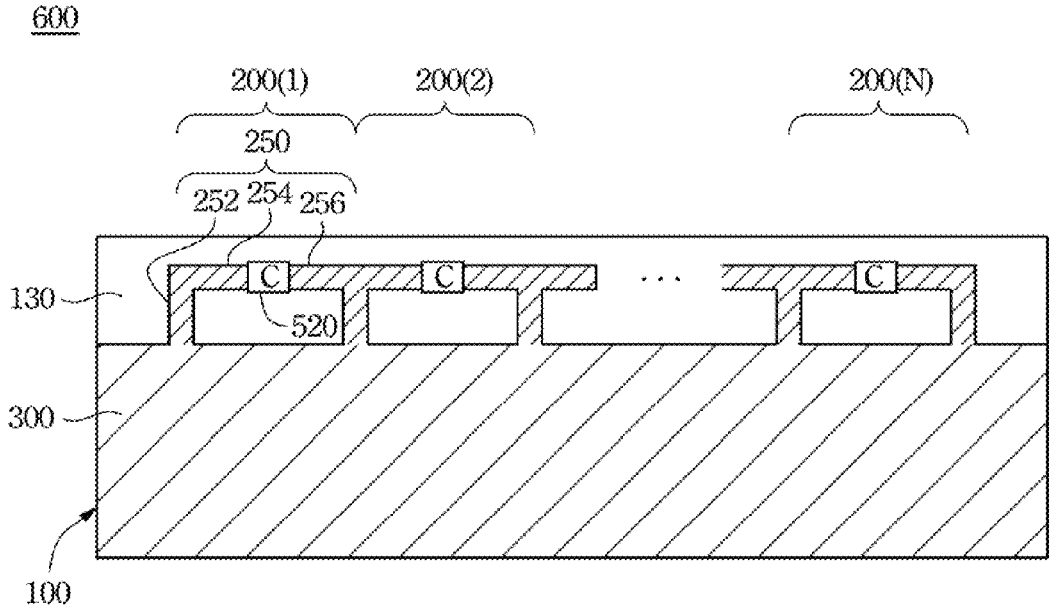
FIG. 6 shows an electromagnetic band-gap structure with the chip capacitance according to one embodiment of the present invention

FIG. 6 is the drawing of the electromagnetic band-gap structure according to another embodiment of the present invention. As shown in FIG. 6, the electromagnetic band-gap structure 600 includes a circuit board 100, a ground plane 300 and a plurality of electromagnetic band-gap units 200(1)~200(N). The circuit board 100 includes a surface 130, and the ground plane is disposed on the surface 130. A plurality of electromagnetic band-gap units 200(1)~200(N) is located on the surface 130 of the circuit board 100. The plurality of electromagnetic band-gap units 200(1)~200(N) are connected to each other along a edge of the ground plane 300, and every electromagnetic band-gap unit includes a strip line 250 and a chip capacitance 520. The strip line 250 located on the surface 130 has a relatively short line 252, a first relatively long line 254 and a second relatively long line 256, where the relatively short line 252 and the first relatively long line 254 are connected to each other, and the relatively short line 252 is connected to the ground plane 300. The chip capacitance 520 is serially connected to the first relatively long line 254 and the second relative short line 256.

The electromagnetic band-gap structure 600 described above, the strip line 250 has an L-shape, and the strip line 250 is the printed line on the circuit board 100. The ground plane 300 has a rectangular shape whose size is fit for the notebook or PDA.

Moreover, every strip line 250 in the electromagnetic band-gap unit could constitute an inductance at the operation frequency of the electromagnetic band-gap structure. The longer the length of the strip line 250 is, the greater the value of the inductance is. With the use of the chip capacitance 520, it could constitute an LC parallel circuit, which has a high impedance surface and a reflection phase of zero degree.

Figure 7:
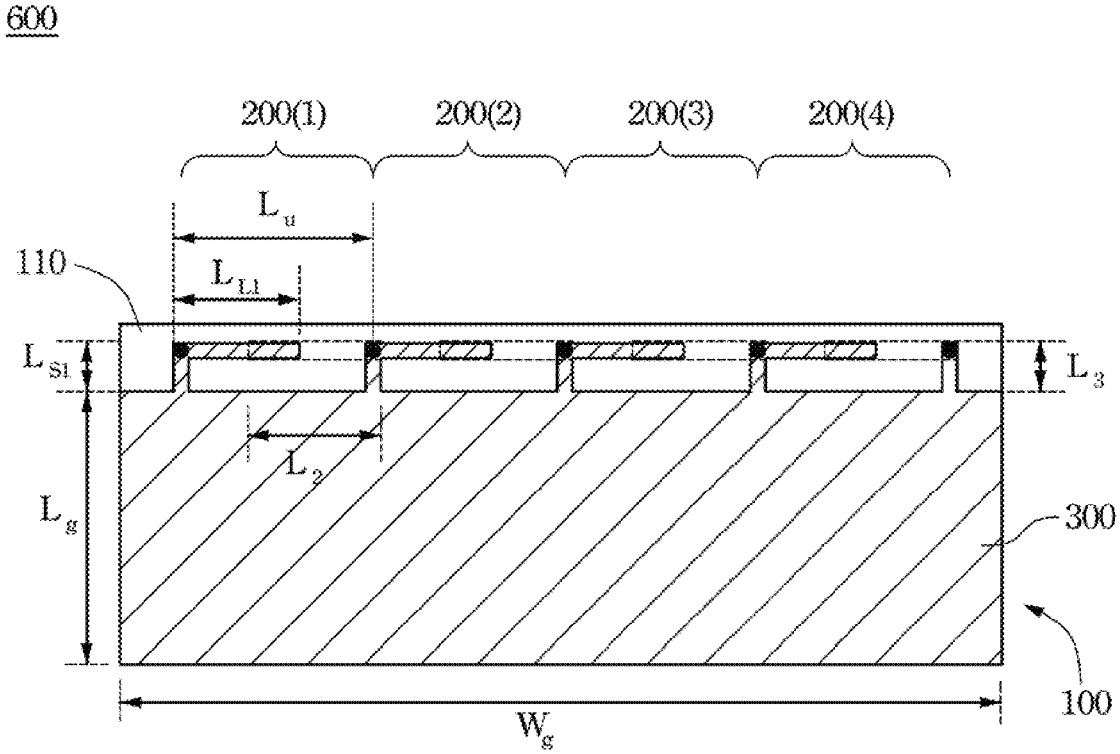
FIG. 7 shows an electromagnetic band-gap structure with four electromagnetic band-gap units in FIG. 1.

FIG. 7 is the drawing of the electromagnetic band-gap structure with four electromagnetic band-gap units in FIG. 1. In every electromagnetic band-gap unit, the length ($L_{L1}$) of the relative long line 214 and the length ($L_2$) of the second strip line 220 are 14.2 mm, and the length ($L_u$) of every electromagnetic band-gap unit 200 is 20 mm. In every electromagnetic band-gap unit, the length ($L_{S1}$) of the relative short line 212 and the length ($L_3$) of the third strip line 240 are all 4 mm. The length ($L_g$) and width ($W_g$) of the ground plane 300 are respectively 30 mm and 153 mm, and the circuit board might be constructed from the material such as FR-4 whose thickness is 0.4 mm.

Figure 8A:
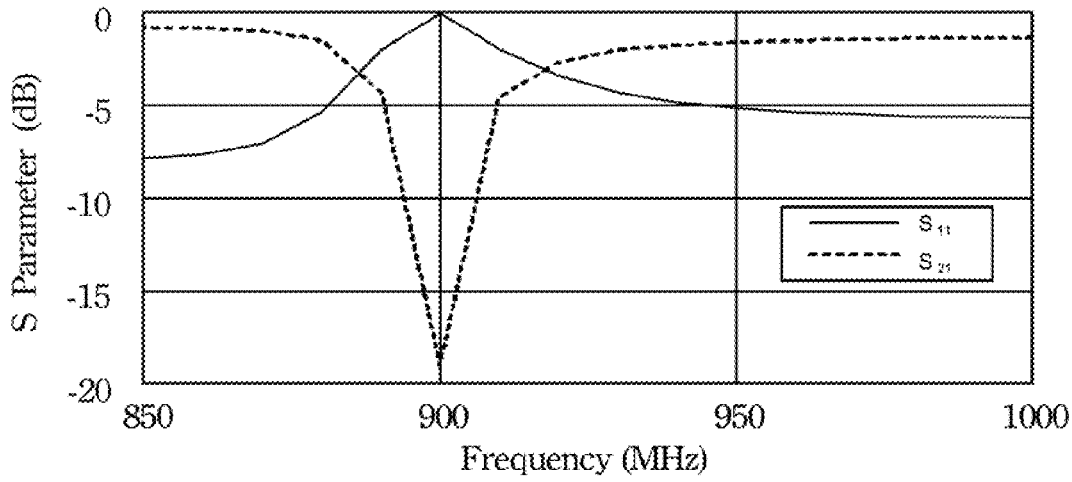
FIG. 8A shows the simulated $S_{11}$ and $S_{21}$ parameters based on the electromagnetic band-gap structure in FIG. 7.

FIG. 8A is the magnitude of the simulated $S_{11}$ parameters and $S_{21}$ parameters based on the electromagnetic hand-gap structure in FIG. 7 with the use of the Ansoft High Frequency Structure Simulator (HFSS). The $S_{11}$ parameter and the $S_{21}$ parameter respectively represent return loss and insertion loss. As shown in FIG. 8A, when the frequency is 900 MHz, the corresponding $S_{11}$ parameter is close to 0 dB and the corresponding $S_{21}$ parameter is close to −20 dB representing that the electromagnetic band-gap structure is in the high impedance or open state.

Figure 8B:
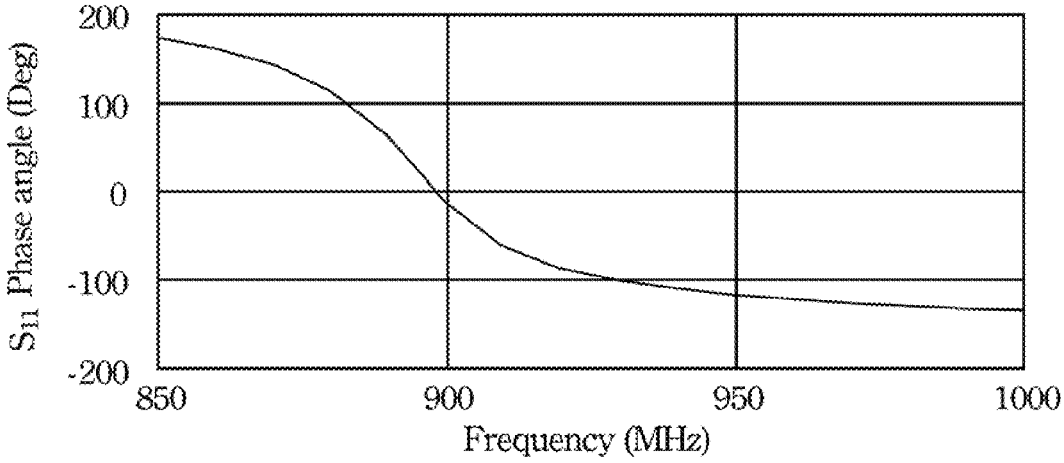
FIG. 8B shows the simulated $S_{11}$ phase angle based on the electromagnetic band-gap structure in FIG. 7.

FIG. 8B is the phase degree of the simulated $S_{11}$ parameters based on the electromagnetic band-gap structure in FIG. 7 with the use of the Ansoft HFSS. As shown in FIG. 8B, when the frequency is at 900 MHz, the corresponding phase degree of the $S_{11}$ parameters is zero. Consequently, in accordance with the simulated S parameters in FIG. 8A and FIG. 8B, it is obvious that the electromagnetic band-gap structure provided in the present invention could be equivalent to an LC parallel circuit which is regarded as a perfect magnetic conductor at the frequency of 900 MHz.

Figure 9A:
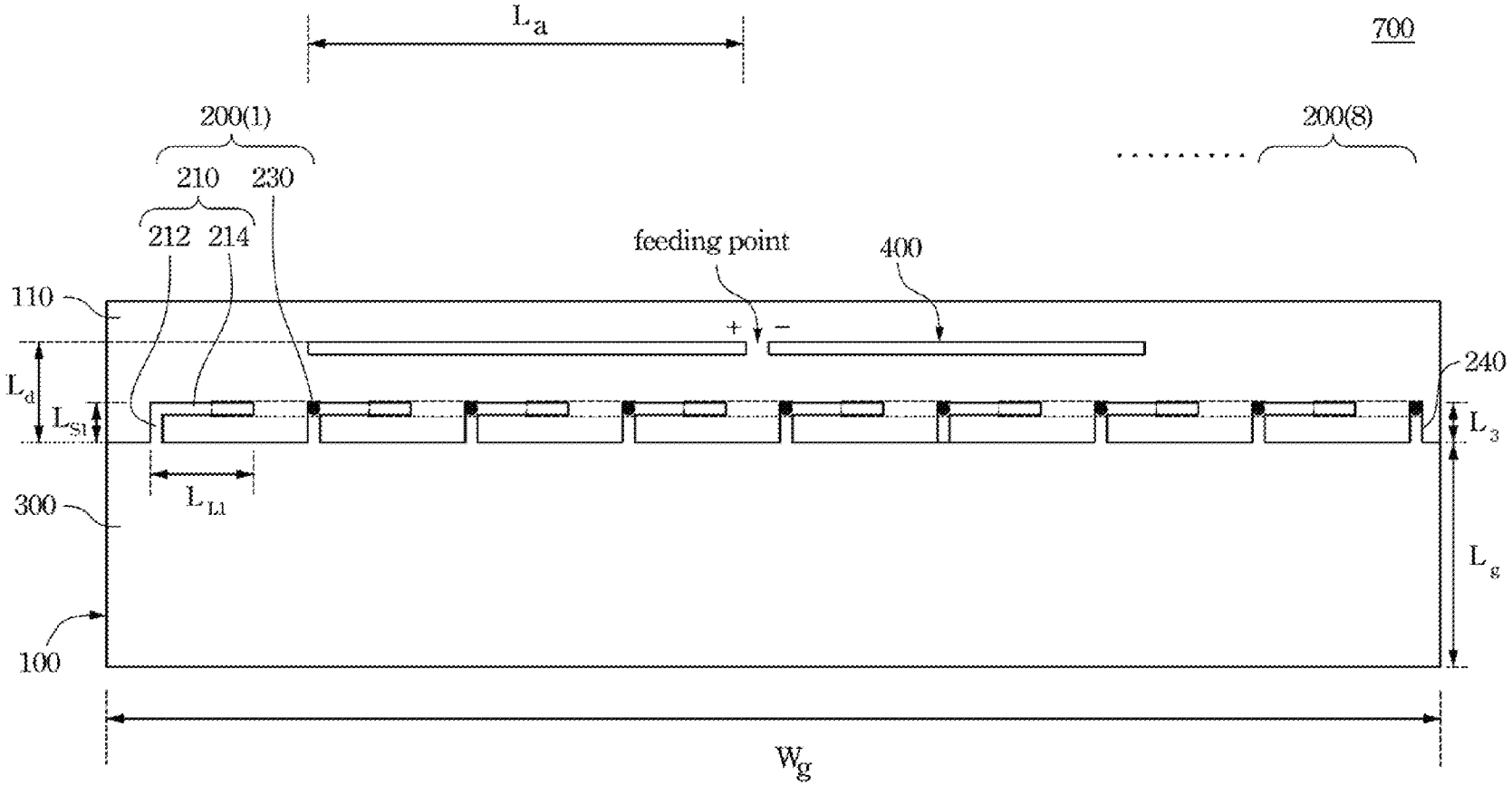
FIG. 9A shows the top view of the planar antenna with the electromagnetic band-gap structure according to one embodiment of the present invention.
Figure 9B:
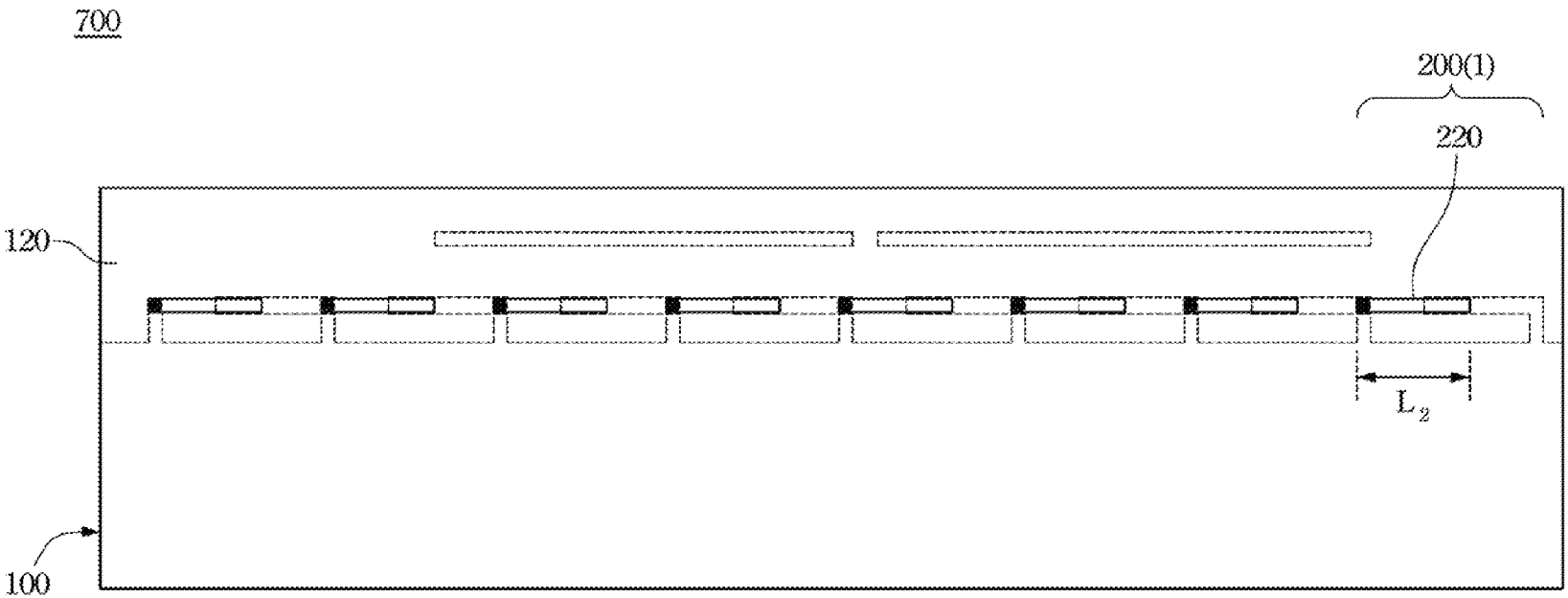
FIG. 9B shows the bottom view of the planar antenna with the electromagnetic band-gap structure according to one embodiment of the present invention.

FIG. 9A and FIG. 9B are respectively the top view and bottom view of the planar antenna with the electromagnetic band-gap structure according to the embodiment of the present invention. As shown in FIG. 9A and FIG. 9B, the planar antenna 700 with the electromagnetic band-gap structure includes a circuit board 100, a ground plane 300, eight electromagnetic band-gap units 200(1)~200(8) and an antenna 400. The circuit board 100 has a first surface 110 and a second surface 120, which are opposite to each other, and the ground plane 300 is disposed on the first surface 110. A plurality of electromagnetic band-gap units 200(1)~200(8) is located on the first surface 110 and the second surface 120. The plurality of electromagnetic band-gap units 200(1)~200(8) are connected to each other along an edge of the ground plane 300, where every electromagnetic band-gap unit has a first strip line 210, a second strip line 220 and a via 230. The first strip line 210 is located on the first surface 110, and the first strip line 210 has a relatively short line 212 and a relatively long line 214, where the relatively short line 212 and the relatively long line 214 are connected to each other, and the relatively short line 212 is connected to the ground plane 300. The second strip line 220 is located on the second surface 120, wherein second strip line 220 is aligned with the relatively long line 214. The via 230 is through the circuit board 100, having the second strip line 220 and a first strip line 210 of the neighboring electromagnetic band-gap unit connected. Furthermore, the antenna 400 is disposed above the plurality of electromagnetic band-gap units 200(1)~200(8).

Referring to FIG. 9A, the electromagnetic band-gap structure includes a third strip line 240 connected to the ground plane 300, where third strip line 240 is located on the first surface 110 and disposed next to the eighth electromagnetic band-gap unit 200(8). Consequently, the third strip line 240 is connected the second strip line 220 of the eighth electromagnetic band-gap unit 200(8) through the via 230 of the eighth electromagnetic band-gap unit 200(8). In addition, the size of the ground plane 300 is ground plane of the notebook or PDA and the antenna 400 could be a monopole antenna or a dipole antenna.

In the planar antenna 700 of the electromagnetic band-gap structure, the ground plane 300 has a rectangular shape. The first strip line 210 and the second strip line 220 have an L-shape and a long shape respectively, and the third strip line 240 also has a long shape. Additionally, the first strip line 210, the second strip line 220, the third strip line 240 and the antenna 400 are all printed lines on the circuit board 100.

In accordance with the simulated data and the description in FIG. 8A and FIG. 8B, it is known that the plurality of electromagnetic band-gap units 200(1)~200(8) could be equivalent to an LC parallel circuit with a high impedance surface and a reflection phase of zero degree, which makes the ground plane 300 more similar to the perfect magnetic conductor, as a plane wave is normally incidents upon the planar antenna 700. Thus, according to the electrical characteristics of the electromagnetic band-gap structure, the current on the antenna 400 and the image current on the ground plane both flow in the same direction, so that the distance between the antenna 400 and the ground plane 300 could be shortened without affecting the radiation pattern and the gain of the antenna 400. Even though the above description is based on eight electromagnetic band-gap units, the present invention is not limited thereto and the appropriate number of the electromagnetic band-gap units depends on the actual demand and application.

Referring to FIG. 9A, the length ($L_{L1}$) of the relatively long line 214 and the length ($L_2$) of second strip line 220 in every electromagnetic band-gap unit are 13.75 mm, and the length ($L_{S1}$) of the relatively short line 212 and the length ($L_3$) of the third strip line 240 in every electromagnetic band-gap unit are 4 mm. The length ($L_g$) and the width ($W_g$) of the ground plane 300 are 30 mm and 153 mm respectively. The distance ($L_d$) between the antenna 400 and the ground plane 300 is 9 mm, and the circuit board might be constructed from the material such as FR-4 whose thickness is 0.4 mm. The antenna 400 could be a dipole antenna with an electrical length of half-wavelength at the operation frequency, and thus, the length ($L_a$) from the feeding point of the antenna 400 to an open end is 57 mm.

Figure 10A:
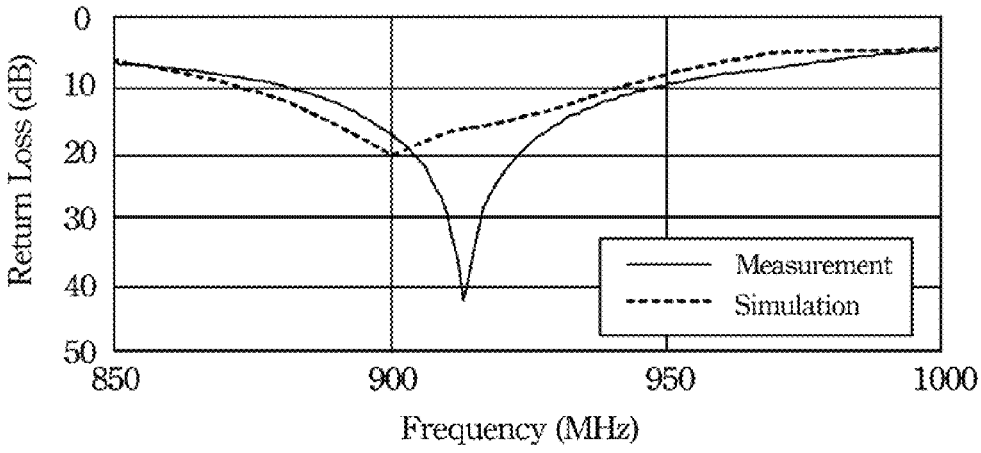
FIG. 10A shows the measured and simulated return loss result based on the planar antenna with the electromagnetic band-gap structure in FIG. 9A and FIG. 9B.

FIG. 10A is the measured and simulated return loss result of the planar antenna 700 with the electromagnetic band-gap structure in FIG. 9A and FIG. 9B. According to the simulated and measured data shown in FIG. 10A, the electromagnetic band-gap structure could be a perfect magnetic conductor in the operating frequency.

Figure 10B:
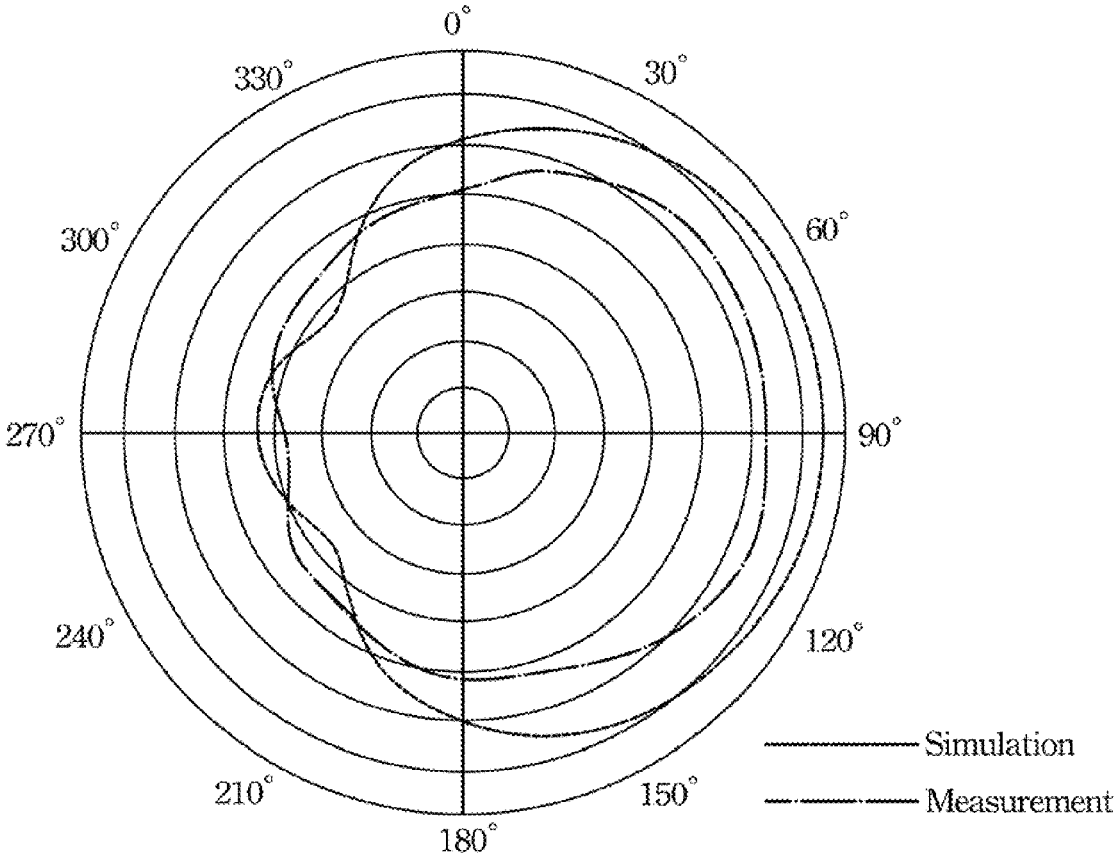
FIG. 10B shows the measured and simulated radiation pattern based on the planar antenna without electromagnetic band-gap structure.
Figure 10C:
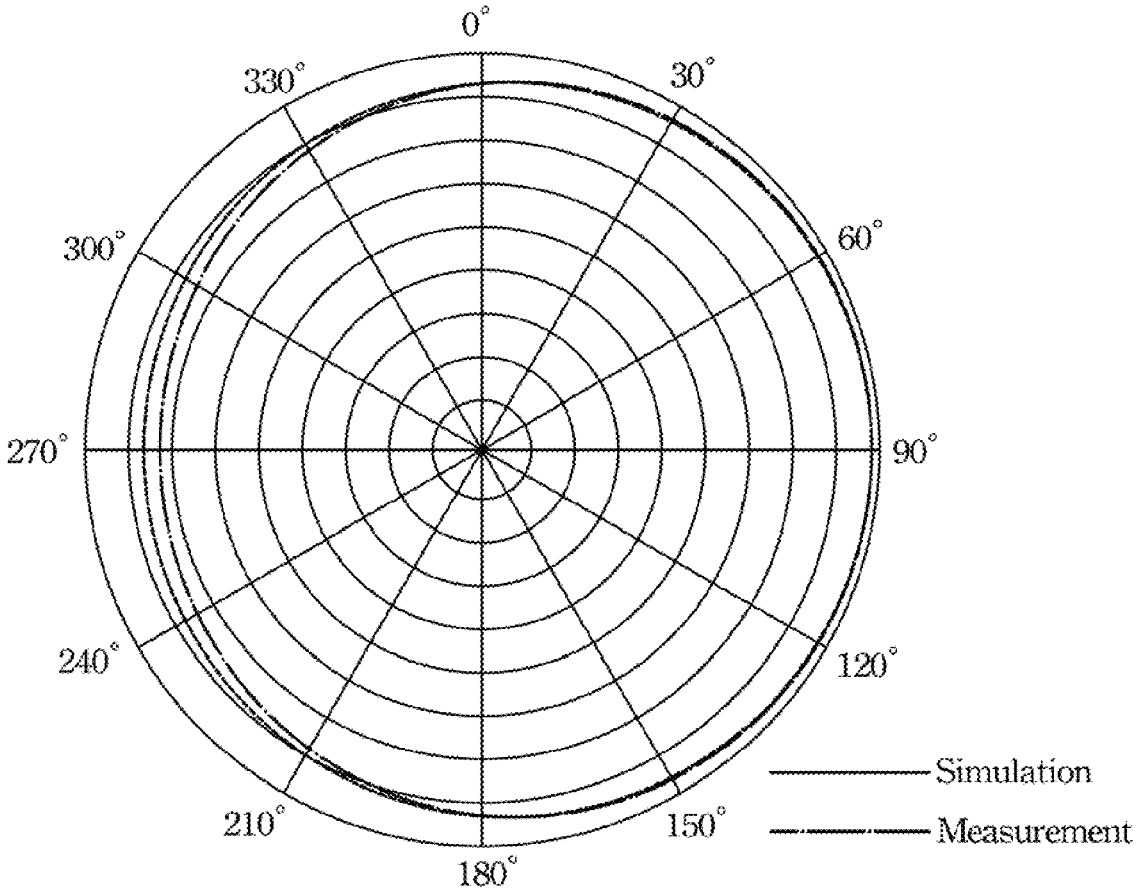
FIG. 10C shows the measured and simulated radiation pattern based on the planar antenna with the electromagnetic band-gap structure in FIG. 9A and FIG. 9B.

FIG. 10B is the measured and simulated radiation pattern of the planar antenna without the electromagnetic band-gap structure and FIG. 10C is the measured and simulated radiation pattern based on the planar antenna with the electromagnetic band-gap structure in FIG. 9A and FIG. 9B. As shown in FIG. 10B and FIG. 10C, since the electromagnetic band-gap structure could be regarded as the perfect magnetic conductor in the operation frequency, which makes the image current of the ground plane and the current on the antenna flow in the same direction, so as to maintain the desired radiation pattern. Moreover, it could improve the poor radiation efficiency and the radiation pattern due to the close proximity between the antenna and the ground plane.

However, as the size of the ground plane of the planar antenna with the electromagnetic band-gap structure is changed, modulating the length of the antenna could maintain the desired radiation pattern. For example, in one embodiment of the present invention, the ground plane is designed for the general notebook, where the length ($L_g$) and the width ($W_g$) of the ground plane 300 are 200 mm and 288 mm. Therefore, the length ($L_a$) from the feeding point of the antenna to the end should be shortened to 51 mm in order to have the same antenna characteristic. According to the embodiment of the planar antenna with the electromagnetic band-gap structure mentioned above, the antenna 400 could be a single frequency antenna or a dual frequency antenna. In a practical design, the distance between the dual frequency antenna and the ground plane should be at least used for the lower frequency, which could be shortened and achieved with the use of the electromagnetic band-gap structure. Furthermore, since the wavelength is inverse to the frequency, the distance between the dual frequency antenna and the ground plane might prevent the high frequency characteristic of the dual antenna from being worsened due to the ground plane.

In another embodiment of the present invention, the value of the inductance in the equivalent circuit of planar antenna with the electromagnetic band-gap structures could be changed with the use of the chip inductance electrically connected in the electromagnetic band-gap units so as to modulate the operation frequency of the electromagnetic band-gaps. Since the arrangement of the chip inductance has already fully been disclosed above, there is no need to repeat the description.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. An high-impedance-surface-featured electromagnetic band-gap structure, comprising:

a circuit board having a first surface and a second surface opposite the first surface;

a ground plane disposed on the first surface; and a plurality of electromagnetic band-gap units sequentially disposed on the circuit board along an edge of the ground plane as a 1-dimensional structure, and every electromagnetic band-gap unit comprises:

a first strip line located on the first surface of the circuit board and having a first line and a second line, wherein an end of the first line is connected to the second line to form a "L" shape appearance and the other end of the first line is connected to the ground plane;

a second strip line located on the second surface of the circuit board, wherein a portion of the second strip line overlaps a second line of a neighboring electromagnetic band-gap unit; and a via formed in a position of the first line connected to the second line and passing through the circuit board, wherein the second strip line is connected to a first strip line of a neighboring electromagnetic band-gap unit through the via.

2. The high-impedance-surface-featured electromagnetic band-gap structure of claim 1, further comprising:

a third strip line located on the circuit board of the first surface, wherein the third strip line is connected to the ground plane and disposed next to the last electromagnetic band-gap unit, and moreover the third strip line is connected to the second strip line of the last electromagnetic band-gap unit through the via of the last electromagnetic band-gap unit.

3. The high-impedance-surface-featured electromagnetic band-gap structure of claim 2, wherein the first strip line, the second strip line and the third strip line are printed lines on the circuit board.

4. The high-impedance-surface-featured electromagnetic band-gap structure of claim 1, wherein the ground plane comprises a rectangular shape.

5. The high-impedance-surface-featured electromagnetic band-gap structure of claim 1, wherein the position of the second strip line overlapping a second line of a neighboring electromagnetic band-gap unit constitutes a capacitance at an operation frequency of the electromagnetic band-gap, and wherein both of the first strip line and the second strip line in the electromagnetic band-gap units, and the fringe of the neighboring ground plane constitute inductances at the operation frequency of the electromagnetic band-gap.

6. The high-impedance-surface-featured electromagnetic band-gap structure of claim 5, further comprising at least one chip inductance serially connected to the electromagnetic band-gap unit and used for modulating the operation frequency of the electromagnetic band-gap.

7. The high-impedance-surface-featured electromagnetic band-gap structure of claim 1, wherein the ground plane is a ground plane of a notebook or a PDA.

8. An electromagnetic band-gap structure, comprising:

a circuit board having a surface;

a ground plane disposed on the surface; and a plurality of electromagnetic band-gap units sequentially disposed on the circuit board along an edge of the ground plane as a 1-dimensional structure and connected in series, wherein every electromagnetic band-gap unit further comprises:

a strip line located on the surface of the circuit board and having a first line, a second line and a third line, wherein a first end of the first line is connected to a first end of the second line and a second end of the first line is connected to the ground plane; and a chip capacitance electrically connected to a second end of the second line and connected to a first end of the third line, wherein a second end of the third line is connected to a first end of a first line of a neighboring electromagnetic band-gap unit.

9. The electromagnetic band-gap structure of claim 8, wherein the strip line is a printed line on the circuit board, comprising an L-shape.

10. The electromagnetic band-gap structure of claim 8, wherein the strip line in every the electromagnetic band-gap unit constitutes an inductance at an operation frequency of the electromagnetic band-gap.

11. The electromagnetic band-gap structure of claim 8, wherein the ground plane is a ground plane of a notebook or a PDA.

12. A planar antenna with high-impedance-surface-featured electromagnetic band-gap structure, comprising:

a circuit board having a first surface and a second surface opposite the first surface;

a ground plane disposed on the first surface;

a plurality of high-impedance-surface-featured electromagnetic band-gap units sequentially disposed on the circuit board along an edge of the ground plane as a 1-dimensional structure, and every high-impedance-surface-featured electromagnetic band-gap unit comprises:

a first strip line located on the first surface of the circuit board and having a first line and a second line, wherein one end of the first line is connected to the second line to form a "L" shape appearance and the other end of the first line is connected to the ground plane;

a second strip line located on the second surface of the circuit board, wherein a portion of the second strip line overlaps a second line of a neighboring high-impedance-surface-featured electromagnetic band-gap unit; and a via formed in a position of the first line connected to the second line and passing through the circuit board, wherein the second strip line is connected to a first strip line of a neighboring high-impedance-surface-featured electromagnetic band-gap unit through the via;

a third strip line located, on the first surface of the circuit board, wherein the third strip line is connected to the ground plane and disposed next to the last electromagnetic band-gap unit, and the third strip line is connected to the second strip line of the last electromagnetic band-gap unit through the via of the last electromagnetic band-gap unit; and an antenna disposed above the high-impedance-surface-featured electromagnetic band-gap units.

13. The planar antenna with a high-impedance-surface-featured electromagnetic band-gap structure of claim 12, wherein the ground plane comprises a rectangular shape.

14. The planar antenna with a high-impedance-surface-featured electromagnetic band-gap structure of claim 12, wherein the first strip line, the second strip line, the third strip line and the antenna are printed lines on the circuit board.

15. The planar antenna with a high-impedance-surface-featured electromagnetic band-gap structure of claim 12, wherein the length of the whole electromagnetic band-gap units is longer than the length of the antenna.

16. The planar antenna with a high-impedance-surface-featured electromagnetic band-gap structure of claim 12, wherein a position of the second strip line overlapping a second line of a neighboring electromagnetic band-gap unit constitutes a capacitance at an operation frequency of the electromagnetic band-gap, and wherein the first strip line and the second strip line in the electromagnetic band-gap units, and the fringe of the neighboring ground plane could constitute inductances at the operation frequency of the electromagnetic band-gap.

17. The planar antenna with a high-impedance-surface-featured electromagnetic band-gap structure of claim 12, further comprising at least one chip inductance serially connected to the electromagnetic band-gap unit for modulating the operation frequency of the electromagnetic band-gap.

18. The planar antenna with a high-impedance-surface-featured electromagnetic band-gap structure of claim 12, wherein the ground plane is a ground plane of a notebook or a PDA.

19. The planar antenna with a high-impedance-surface-featured electromagnetic band-gap structure of claim 12, wherein the antenna is a monopole antenna or a dipole antenna.

20. The planar antenna with a high-impedance-surface-featured electromagnetic band-gap structure of claim 12, wherein the antenna is a single frequency antenna or a dual frequency antenna.

* * * * *